US005872344A

United States Patent [19]

Durand et al.

[11] Patent Number: 5,872,344

[45] **Date of Patent: *Feb. 16, 1999**

[54] STRUT-ACTUATED SWITCH FOR ACTIVATING REAR LIFT GATE OPEN ALARM

[75] Inventors: Remie Durand, Algonac; Erik Larsen, Fenton, both of Mich.

[73] Assignee: Chrysler Coporation, Auburn Hills, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 664,751

[22] Filed: Jun. 17, 1996

[51] Int. Cl.[6] ..... H01H 3/16; H01H 35/00

[52] U.S. Cl. ..... 200/61.72; 200/52 R; 200/61.62

[58] Field of Search ..... 200/52 R, 61.62–61.84, 200/573, 303, 329–332.2, 82 D

[56] References Cited

U.S. PATENT DOCUMENTS

| | | | |
|---|---|---|---|
| 2,845,503 | 7/1958 | Durand | 200/52 |
| 3,610,611 | 10/1971 | Elliott et al. | 267/65 D |
| 4,263,488 | 4/1981 | Freitag et al. | 200/52 R |
| 4,316,098 | 2/1982 | Freitag et al. | 307/119 |
| 4,317,014 | 2/1982 | Langanke | 200/61.62 |
| 4,400,600 | 8/1983 | Freitag et al. | 200/52 R |
| 4,667,940 | 5/1987 | Jaillet | 267/64.11 |
| 4,845,471 | 7/1989 | Chu | 340/542 |
| 5,003,136 | 3/1991 | Valenzona | 200/61.62 |
| 5,043,542 | 8/1991 | McCombs et al. | 200/61.62 |
| 5,410,115 | 4/1995 | Hizume et al. | 200/61.76 |
| 5,597,441 | 1/1997 | Volk | 156/579 |

*Primary Examiner*—Wynn Wood Coggins
*Assistant Examiner*—Michael J. Hayes
*Attorney, Agent, or Firm*—Thomas G. Pasternak

[57] ABSTRACT

A switch housing surrounds a strut and cylinder, with the strut and cylinder being mounted between the rear lift gate window of a vehicle and an interior surface of the vehicle. A switch is disposed in the housing, and when the window is opened or broken, the strut moves relative to the cylinder to actuate the switch and thereby generate a lift gate open alarm signal.

12 Claims, 2 Drawing Sheets

STRUT-ACTUATED SWITCH FOR ACTIVATING REAR LIFT GATE OPEN ALARM

FIELD OF INVENTION

The present invention relates generally to vehicle access doors, and more particularly to systems for sensing the unauthorized opening or breakage of a vehicle access door, such as a pivotable rear window.

BACKGROUND OF THE INVENTION

Many vehicles are equipped with steel or glass access doors that are pivotably attached to the vehicle about the upper edge of the door. Such access doors, referred to herein as "rear lift gates", can be opened by raising the lift gate, thereby exposing the passenger compartment. Frequently, torque-assist pneumatic cylinders are connected between a rear lift gate and vehicle body to assist in raising the lift gate, when a person lifts upwardly on the lift gate.

It happens that in many vehicles, rear lift gates (and other doors on the vehicle) cannot properly be opened unless a person first transmits a security signal from a hand-held transmitter to the vehicle. In other words, many vehicles are equipped with electronic security systems which incorporate user-generated authenticating signals to disarm the security system and thereby permit access to the interior of the vehicles.

For example, the Viper® coupe made by Dodge has only a single lock cylinder, with the lock cylinder being associated with a rear lift gate window, and the doors of the vehicle can be opened only after transmission of the security signal. While effective, it happens that such security systems can be bypassed by, e.g., breaking the rear lift gate window or by opening the lock cylinder with a master key.

Not surprisingly, systems have been provided which incorporate switches for generating electrical signals when a rear lift gate is open. For example, U.S. Pat. No. 5,003,136 to Valenzona discloses a switch that can be engaged with a rear lift gate assist cylinder to generate a signal when the lift gate is open. Unfortunately, the device disclosed in Valenzona is comparatively complicated, in that it incorporates first and second telescoping sleeves that are spring-loaded in an outer housing, with each sleeve being associated with a respective electrical contact. The sleeves reciprocate relative to each other within the outer housing when the lift gate moves, thereby causing the contacts to touch and generate an electrical signal. Thus, the Valenzona device requires a relatively large number of components and springs which must move relative to each other, in addition to the movement of the torque assist strut within the cylinder. As recognized herein, however, it is possible to provide a simple, inexpensive switch for generating an alarm to indicate unauthorized entry through an access door having a torque-assist cylinder.

Accordingly, it is an object of the present invention to provide a method and apparatus for generating an alarm signal to indicate the unauthorized opening of a vehicle access door. Another object of the present invention is to provide a method and apparatus for generating an alarm signal that uses existing torque assist cylinders. Yet another object of the present invention is to provide a method and apparatus for generating an alarm signal when a rear lift gate door is opened without electronic authorization. Still another object of the present invention is to provide a method and apparatus for generating an alarm signal in a vehicle which is easy to use and cost-effective.

SUMMARY OF THE INVENTION

A switch assembly is disclosed that is engageable with a vehicle torque assist apparatus which includes a strut defining a diameter and cylinder defining a diameter. As described in detail below, the switch assembly includes a hollow two-piece plastic housing formed with a strut channel and a cylinder channel. The strut channel defines a diameter that is about equal to the diameter of the strut, whereas the cylinder channel defines a diameter that is marginally larger than the diameter of the cylinder. Consequently, the strut channel is surroundingly engaged with the strut, and the cylinder is slidably engaged with the cylinder channel. As intended by the present invention, the channels are coaxial and contiguous with each other.

Additionally, a switch is disposed in the housing adjacent the cylinder channel. The switch can be a microswitch or a two-contact switch. In accordance with the present invention, the switch includes an actuating contact that is biased to a first position, wherein the actuating contact protrudes into the cylinder channel. Also, the actuating contact is movable to a second position, wherein the cylinder urges the actuating contact away from the cylinder channel. When the actuating contact is in the first position, the switch generates an open signal.

In the presently preferred embodiment, the housing includes a first molded piece and a second molded piece, and the pieces are mirror images of each other. The pieces being held together by fasteners. Moreover, the switch assembly may be used in combination with the torque assist apparatus and with an associated vehicle.

In another aspect of the present invention, a device is disclosed for use in a torque assist apparatus which opens a door of a vehicle. The device is a switch assembly for generating a signal representative of the movement of a cylinder relative to a strut from a door closed position, wherein the strut is nested within the cylinder, and a door open position, wherein the strut is telescoped from the cylinder. Per the present invention, the switch assembly includes a plastic housing that is formed with a strut channel configured for stationarily receiving the strut therein and a cylinder channel configured for slidably receiving the cylinder therein. A switch is positioned in the housing, and the cylinder is reciprocatingly received in the housing to facilitate movement of the switch to a first position when the cylinder is in the door open position. In contrast, the cylinder urges the switch to a second position when the cylinder is in the door closed position.

The details of the present invention, both as to its structure and operation, can best be understood in reference to the accompanying drawings, in which like reference numerals refer to like parts, and in which:

DETAILED DESCRIPTION OF THE PREFERRED EMBODIMENT

Figure 1:
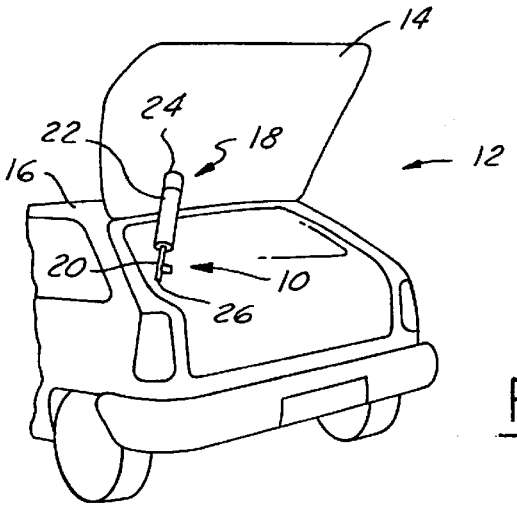
FIG. 1 is a perspective view of a vehicle incorporating the switch assembly of the present invention in operable engagement with a strut and cylinder torque assist apparatus for urging a rear lift gate toward a raised position, with the torque assist assembly in the telescoped position.

Referring initially to FIG. 1, a switch assembly, generally designated 10, is shown in engagement with a vehicle, generally designated 12, which includes a rear lift gate 14 that is pivotably engaged with a body 16 of the vehicle 12 between a closed position and a raised position, in accordance with principles well-known in the art. In one presently preferred embodiment, the rear lift gate 14 is made of glass, although the rear lift gate can be made of steel.

In any case, a torque assist apparatus, generally designated 18, is operably engaged with the vehicle 12 to urge the rear lift gate 14 toward the raised position. As shown in FIG. 1 and described in detail below, the switch assembly 10 is attached to the torque assist apparatus 18. Per the present invention, the torque assist apparatus 18 is a conventional pneumatic device that is commercially available. Accordingly, the torque assist apparatus 18 includes a steel strut 20 that is reciprocatingly engaged with a metal cylinder 22 for movement from a nested position, wherein the strut 20 is nested substantially within the cylinder 22 and the lift gate 14 is in the closed position, and a telescoped position, wherein the cylinder 22 is telescoped outwardly from the strut 20 and the lift gate 14 is in the raised position shown in FIG. 1. Per principles well-known in the art, a cylinder socket 24 pivotably joins the cylinder 22 with complementary structure that is glued to the glass lift gate 14. On the other hand, a strut socket 26 pivotably joins the strut 20 with complementary structure that is fastened to the vehicle 12 within the interior of the vehicle 12.

Figure 2:
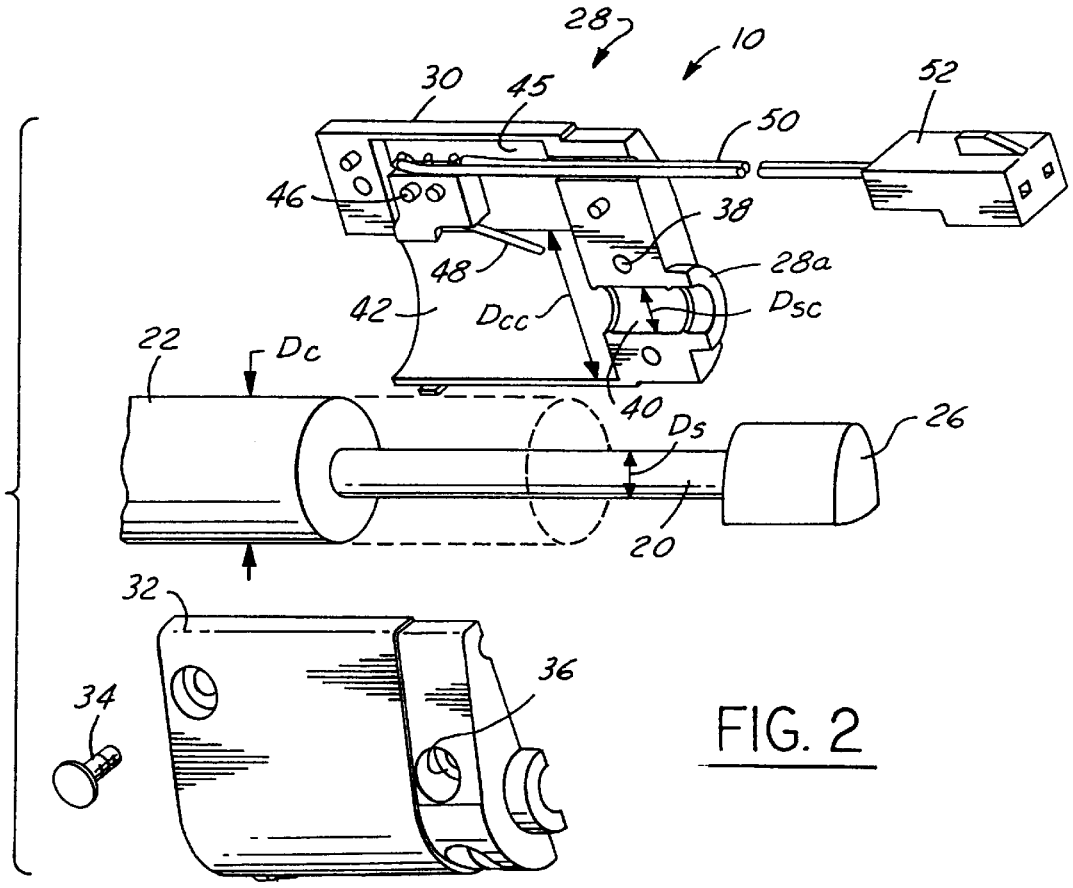
FIG. 2 is an exploded perspective view of the switch assembly and torque assist apparatus, showing in solid lines the torque assist apparatus in the telescoped position and showing in phantom the torque assist apparatus in the nested position.

Now referring to FIG. 2, the details of the switch assembly 10 can be seen. As shown, the switch assembly 10 includes a hollow two-piece molded plastic housing, generally designated 28. In the presently preferred embodiment, the housing 28 includes a first molded piece 30 and a second molded piece 32. It can be appreciated in reference to FIG. 2 that the pieces 30, 32 are mirror images of each other. Preferably, the pieces 30, 32 are held together by a plurality of threaded fasteners 34 (only one fastener 34 shown in FIG. 2). More particularly, the fasteners 34 extend through respective holes 36 in the second piece 32 and are threadably engaged with respective receptacles 38 in the first piece 30.

It can be further appreciated in reference to FIG. 2 that when the pieces 30, 32 of the housing 28 are connected together, the housing 28 defines a strut channel 40 that has a tubular wall. As shown, the strut channel 40 defines a diameter $D_{SC}$ that is about equal to the diameter $D_S$ of the strut 20, such that the strut channel 40 can be closely engaged with the strut 20 in a surrounding relationship therewith. Accordingly, with the strut channel 40 of the housing 28 closely surrounding the strut 20, an interference fit is established between the housing 28 and strut 20 such that the housing 28 is held stationary relative to the strut 20. When the housing 28 is engaged with the strut 20 as intended by the present invention, an abutment collar 28*a* that circumscribes the strut channel 40 abuts the strut socket 26 of the strut 20.

Moreover, the housing 28 is also formed with a cylinder channel 42 that has a tubular wall. As shown in FIG. 2, the cylinder channel 42 defines a diameter $D_{CC}$ that is marginally larger than the diameter $D_C$ of the cylinder 22. Thus, unlike the strut 20/strut channel 40, the cylinder 22 is slidably engaged with the cylinder channel 42. In other words, the strut channel 40 is configured for stationarily receiving the strut 20 therein, whereas the cylinder channel 42 is configured for slidably receiving the cylinder 22 therein. As can be seen in FIG. 2, the channels 40, 42 are coaxial and contiguous with each other.

FIG. 2 shows that a switch 44 is disposed in the housing 28 adjacent the cylinder channel 42. More particularly, the switch 44, which can be a conventional type 311SX-3T device made by the Microswitch division of Honeywell of Freeport, Ill., is attached to an interior cavity 45 in the first piece 30 of the housing 28 by heat staking the switch 44 to plastic posts 46 which are formed integrally with the first piece 30.

In accordance with the present invention, the switch 44 includes an elongated, metal, cantilevered arm-like actuating contact 48. Per principles of the present invention, the switch 44 is oriented in the housing 28 such that the actuating contact 48 is biased to a first position (shown in FIG. 2), wherein the actuating contact 48 protrudes into the cylinder channel 42. Accordingly, it can readily be appreciated that the first position of the actuating contact 48 is established when the cylinder 22 moves away from the nested position (shown in phantom in FIG. 2) toward the telescoped position (shown in solid in FIG. 2) and consequently is distanced from the actuating contact 48. Hence, the first position of the actuating contact 48 corresponds to a position of the rear lift gate 14 that is somewhat raised from the fully closed position. In one preferred embodiment, the switch 44 is open when the actuating contact 48 is in the first position.

In contrast, when the cylinder 22 is moved to the fully nested position (shown in phantom in FIG. 2) and the lift gate 14 accordingly is closed, the actuating contact 48 is moved by the cylinder 22 to a second position. In the second position, the actuating contact 48 rides on the surface of the cylinder 22, such that the cylinder 22 urges the actuating contact 48 away from the cylinder channel 42. In the second position, the switch 44 closes to generate an open signal. The open signal is sent via a two-conductor cable 50 to a conventional connector 52, and from thence to the security alarm system (not shown) of the vehicle 12.

Thus, it will be appreciated that the switch assembly 10 generates a signal representative of the movement of a cylinder 22 relative to a strut 20 from a lift gate 14 closed position, wherein the strut 20 is nested within the cylinder 22, to a lift gate 14 open position, wherein the strut 20 is telescoped from the cylinder 22. Stated differently, when not in its nested position, which corresponds to the lift gate 14 being closed, the cylinder 22 is distanced from the switch 44 to permit movement of the actuating contact 48 to its first position. In contrast, when the lift gate 14 is closed and the cylinder 22 is in its nested position, the cylinder 22 urges the switch 44 to the second position.

With the above disclosure in mind, the advantages of the present invention vis-a-vis the Valenzona device mentioned above can readily be appreciated. Specifically, the present invention permits the use of a single integrated switch with a conventional torque assist apparatus. Additionally, the present invention is relatively simple yet highly effective, incorporating only a single moving part (the actuating contact 48) in addition to the torque assist apparatus, in marked contrast to the plurality of moving sleeves, springs, and contacts of the Valenzona device.

Figure 3:
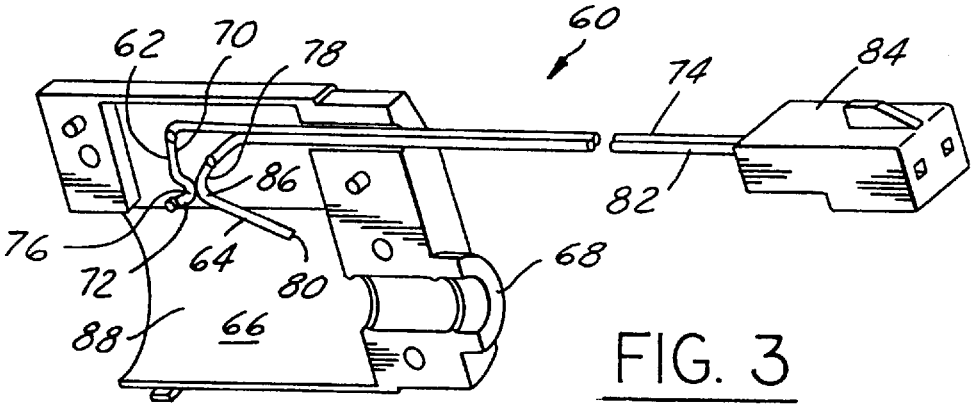
FIG. 3 is a perspective view of one piece of the housing of an alternate embodiment, showing an alternate switch.

Referring now to FIG. 3, an alternate switch assembly is shown, generally designated 60. It is to be understood that the switch assembly 60 shown in FIG. 3 is in all essential respects identical to the switch assembly 10 shown in FIGS. 1 and 2, except that the switch assembly 60 in FIG. 3 does not incorporate an off-the-shelf microswitch. Instead, as shown in FIG. 3 the alternate switch assembly 60 includes a switch that is established by a stationary metal contact 62 and a cantilevered actuating contact 64, with the contacts 62, 64 being heat-staked to a first piece 66 of a housing 68.

More specifically, the stationary contact 62 is heat-staked at both of its ends 70, 72 to the first piece 66. Further, the stationary contact 62 is electrically connected to a first conductor 74. As shown, the stationary contact 62 is formed with a curved bight segment 76.

In contrast, the actuating contact 64 is heat staked to the first piece 66 only at a fixed end 78 of the actuating contact 64. Consequently, the actuating contact 64 is cantilevered, and accordingly defines a free end 80 that is moved as described above by a cylinder of a torque assist apparatus (not shown in FIG. 3). It can be appreciated in reference to FIG. 3 that the actuating contact 64 is electrically connected to a second lead 82, and the leads 74, 82 are connected to a connector 84. Like the stationary contact 62, the actuating contact 64 is formed with a curved bight segment 86.

With the above-described combination of structure in mind, the actuating contact 64 is biased to a first position as shown, wherein the free end 80 of the actuating contact 64 protrudes into a cylinder channel 88 of the housing 68. In the first position, the bight segments 76, 86 of the contacts 62, 64 touch, and a complete electrical circuit consequently is established between the poles of the connector 84 to generate an open signal. Owing to the spring bias of the bight segments 76, 86, the segments 76, 86 are urged against one another in the first position, to ensure a reliable electrical connection therebetween.

Additionally, the actuating contact 64 can be moved by the cylinder of a torque assist apparatus to a second position, wherein the free end 80 of the actuating contact 64 is urged out of the cylinder channel 88. In the second position, the bight segment 86 of the actuating contact 64 is pivoted away from the bight segment 76 of the stationary contact 62, thereby interrupting the electrical circuit between the poles of the connector 84.

While the particular STRUT-ACTUATED SWITCH FOR ACTIVATING REAR LIFT GATE OPEN ALARM as herein disclosed and described in detail is fully capable of attaining the above-described objects of the invention, it is to be understood that it is the presently preferred embodiment of the present invention and is thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims.

I claim:

1. A switch assembly engageable with a vehicle torque assist apparatus including a strut defining a diameter and cylinder defining a diameter, comprising:

a hollow two-piece plastic housing formed with a strut channel defining a diameter about equal to the diameter of the strut and surroundingly engaged therewith, the housing also being formed with a cylinder channel defining a diameter marginally larger than the diameter of the cylinder and slidably engaged therewith, the channels being coaxial and contiguous with each other, and a switch disposed in an internal cavity within the housing adjacent to an outer perimeter of the cylinder channel and in communication therewith, the switch including an actuating contact configured for cantilevered movement relative to the housing, the actuating contact being biased to a first position, wherein the actuating contact protrudes from the cavity into the cylinder channel, the actuating contact being movable to a second position, wherein the cylinder contacts and urges the actuating contact away from the cylinder channel, the switch generating a door open signal when the actuating contact is in the first position.

2. The switch assembly of claim 1, wherein the switch is a microswitch.

3. The switch assembly of claim 1, wherein the switch includes a stationary contact formed with a bight-shaped segment for abutting the actuating contact when the actuating contact is in the first position.

4. The switch assembly of claim 1, wherein the housing includes a first molded piece and a second molded piece, and the pieces are mirror images of each other, the pieces being held together by fasteners.

5. The switch assembly of claim 4, in combination with the torque assist apparatus.

6. The combination of claim 5, in combination with a vehicle.

7. In a torque assist apparatus for opening a door of a vehicle, a switch assembly for generating a signal representative of the movement of a cylinder relative to a strut from a door closed position, wherein the strut is nested within the cylinder, and a door open position, wherein the strut is telescoped from the cylinder, the switch assembly comprising:

a plastic housing formed with a strut channel configured for stationarily receiving the strut therein; and a cylinder channel configured for slidably receiving the cylinder therein; and a switch mounted within an internal cavity that is adjacent to an outer perimeter of the cylinder channel and in communication therewith, said switch into the cylinder channel including a cantilevered actuating contact protruding from the cavity and a fixed contact, the fixed contact positioned in the housing, the cylinder being reciprocatingly received in the housing to facilitate movement of the actuating contact to a first position when the cylinder is in the door open position, wherein the actuating contact is distanced from the fixed contact, the cylinder contacting and urging the actuating contact to a second position when the cylinder is in the door closed position, wherein the actuating contact abuts the fixed contact.

8. The switch assembly of claim 7, wherein the switch includes an actuating contact biased to the first position, wherein the actuating contact protrudes into the cylinder channel to generate a door open signal.

9. The switch assembly of claim 8, wherein the housing includes a first molded piece and a second molded piece, and the pieces are mirror images of each other, the pieces being held together by fasteners.

10. The switch assembly of claim 9, in combination with the torque assist apparatus and the vehicle.

11. A vehicle, comprising:

a body;

a lift gate pivotally engaged with the body between a closed position and a raised position;

a torque assist apparatus engaged with the lift gate for urging the lift gate toward the raised position, the torque assist apparatus including a strut defining a diameter and cylinder defining a diameter; and a switch assembly including:

a hollow two piece plastic housing formed with a strut channel for stationarily receiving the strut and a cylinder channel for slidably receiving the cylinder, the channels being coaxial and contiguous with each other; and a switch disposed in an internal cavity within the housing adjacent to an outer perimeter of the cylinder channel and in communication therewith, the switch including an actuating contact, the actuating contact being biased to a first position, wherein the actuating contact protrudes from the cavity into the cylinder channel, the actuating contact begin movable to a second position, wherein the cylinder contacts and urges the actuating contact away from the cylinder channel, the switch generating a gate open signal when actuating contact is in the first position.

12. The vehicle of claim 11, wherein the housing includes a first molded piece and a second molded piece, and the pieces are mirror images of each other, the pieces being held together by fasteners.

* * * * *